United States Patent [19]

L'Homme et al.

[11] Patent Number: 4,484,788

[45] Date of Patent: Nov. 27, 1984

[54] FLUSH PULL DRAWER HANDLE FOR CABINET

[75] Inventors: Louis L'Homme, St-Jean; Pierre Pontbriand, Montreal; Georges Guichard, St-Michel, all of Canada

[73] Assignee: Artopex Inc., Laval, Canada

[21] Appl. No.: 415,914

[22] Filed: Sep. 8, 1982

[51] Int. Cl.[3] ..... A47B 95/02

[52] U.S. Cl. ..... 312/320; 312/234.5

[58] Field of Search ..... 16/114 R, DIG. 24; 40/325; 312/234.5, 239, 244, 320, 234 T, DIG. 33

[56] References Cited

U.S. PATENT DOCUMENTS

| | | | |
|---|---|---|---|
| 2,472,479 | 6/1949 | Hoff | 16/114 R |
| 3,098,686 | 7/1963 | Benoit | 312/320 |
| 3,120,984 | 2/1964 | Stohlberg | 312/320 |
| 3,338,649 | 8/1967 | Stewart | 312/320 |
| 3,862,506 | 1/1975 | Drenten et al. | 40/325 |

FOREIGN PATENT DOCUMENTS

| | | | |
|---|---|---|---|
| 2498995 | 8/1982 | France | 312/320 |

*Primary Examiner*—William E. Lyddane
*Assistant Examiner*—Joseph Falk
*Attorney, Agent, or Firm*—Oblon, Fisher, Spivak, McClelland & Maier

[57] ABSTRACT

A flush drawer handle for a drawer having at least a flat metal frontal wall portion about the handle. The handle comprises a handle slot having opposed horizontal edges and end edges. Flanges are provided in at least opposed ones of the horizontal edges and formed integral with the frontal wall portion and extending inwardly of the frontal wall. A rear wall member is also provided and defines a rear wall portion and side wall portions extending transverse to a common side of the rear wall portion. The side wall portions have retention tabs for releasable securement with the flanges.

10 Claims, 4 Drawing Figures

FLUSH PULL DRAWER HANDLE FOR CABINET

BACKGROUND OF THE INVENTION

1. Field of Invention

The present invention relates to a flush drawer handle for a cabinet drawer having at least a flat metal frontal wall portion about the handle.

2. Description of Prior Art

Flush drawer handles are known. It is further known to provide a flush drawer handle wherein a slot is provided in the drawer front wall and a backing plate is secured adjacent the slot and spaced from the rear wall thereof and usually permanently secured at that position by means of spot welds or other permanent securing means. It is also known to provide a backing plate which is removably secured to the drawer behind a handle slot and such have been found complex in structure and unreliable. Such structures usually require a securement piece which fits about the handle slot to retain the back plate in position.

The disadvantages of the above mentioned prior art type flush drawer handles are many although these structures appear relatively simple in construction. For example, when the backing plate is permanently secured behind the slot opening there is usually weld spots appearing about the handle opening on the front wall of the drawer. During construction of such handle it is often required to file down any weld points on the front of the drawer and therefore careful quality control is necessary to examine the welds and to repair them when necessary. Further, when painting such handle it is very difficult to paint the back wall of the handle which is recessed inside the opening. A further disadvantage is that when it is necessary to provide a removable securement piece along the edges of the slot there is the risk that such pieces be dislodged during use of the handle and this would cause the backing plate to become detached necessitating repairs. A still further disadvantage of the fixed prior art drawer handles is that they are not removable. An advantage of having the backing plate removable is that it may form part of a color code and by simply removing the backing plate and placing another one with a different color or painting it, a code designation for the drawer is changed.

SUMMARY OF THE INVENTION

It is therefore a feature of the present invention to provide a flush drawer handle which substantially overcomes all of the above mentioned disadvantages of the prior art.

According to a further feature of the present invention there is provided a flush drawer handle which is of a simple construction, does not require any tools for its assembly, does not require stringent quality control inspection during construction, can easily be disassembled, may be provided with a backing plate of different colors, and which is capable of retaining an information carrying member in snap-fit engagement therein.

Another feature of the present invention is to provide a flush drawer handle constructed of a slot having inturned peripheral edges to form flanges to which a cup-shaped rear wall member is secured in snap-fit.

According to the above features, from a broad aspect, the present invention provides a flush drawer handle for a drawer having at least a flat rigid frontal wall portion about the handle. The handle comprises a handle slot having opposed horizontal edges and end edges. Flange means is provided in at least opposed ones of the horizontal edges and formed integral with the frontal wall portion and extending inwardly of the frontal wall. A rear wall member is also provided and defines a rear wall portion and side wall portions extending transverse to a common side of the rear wall portion. The side wall portions have retention means for releasable securement with the flange means rearwardly of the frontal wall portion. The rear wall member surrounds the entire handle slot with the rear wall portion disosed parallel to the slot and recessed therefrom whereby to receive an information carrying member in snap-fit engagement between the parallel horizontal edges and the rear wall portion of the rear wall member.

BRIEF DESCRIPTION OF THE DRAWINGS

A preferred embodiment of the present invention will now be described with reference to an example thereof as illustrated in the accompanying drawings, in which.

Figure 1:
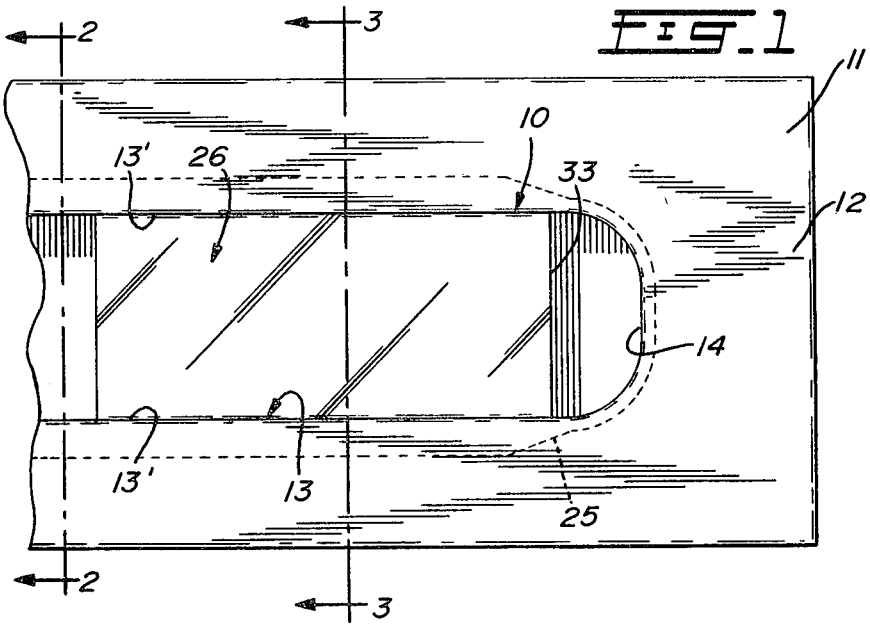
FIG. 1 is a front view of the flush drawer handle of the present invention.

Referring now to the drawings there is shown generally at 10 the flush drawer handle of the present invention provided in a recess in a metallic frontal wall portion 11 of a drawer front wall 12. The drawer handle 10 comprises a handle slot 13 having opposed horizontal edges 13' and end edges 14. As shown in the cross-sectional views in FIGS. 2 and 3, flange means 15 are provided in at least opposed ones of the horizontal edges 13' and are formed integral with the front wall 12 whereby to define an inwardly extending flange portion 16 and a rounded edge 17 about the periphery of the slot opening 13.

Figure 4:
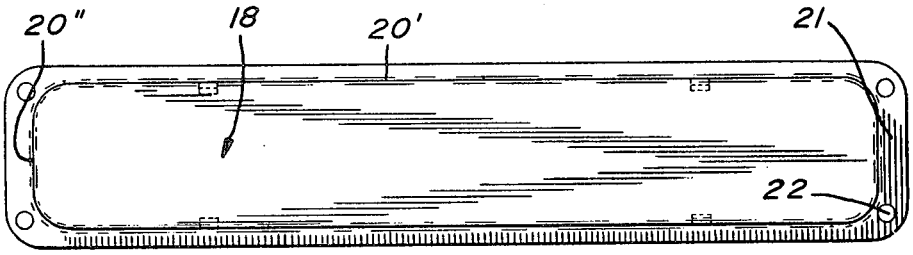
FIG. 4 is a rear view of the rear wall member.

A rear wall member 18 is formed as an elongated cup-shaped member, see FIG. 4, and is detachably securable in snap-fit with the inwardly extending flange portions 16. This rear wall member provides a recessed rear wall 19 extending entriely behind the slot opening 13 and the rear wall member 18 is provided with a side wall 20 extending entirely about the rear wall 19 and transversed to a common side thereof and terminated at its free end edge in an abutment flange 21 which is turned outwardly of the side wall 20 and extends parallel to the rear wall 19.

Figure 2:
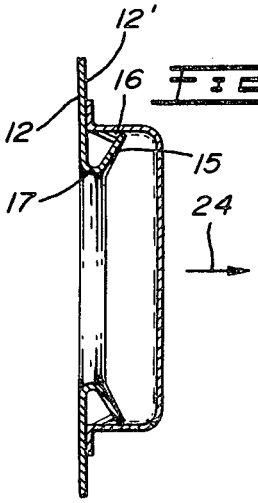
FIG. 2 is a cross-section view along cross-sectional lines II—II of FIG. 1.
Figure 3:
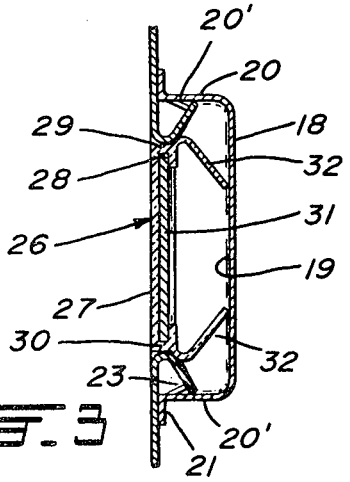
FIG. 3 is a cross-section view along cross-sectional lines III—III of FIG. 1.

To detach the rear wall member from its snap-fit engagement, it is merely necessary to apply outward pressure, by means such as a screwdriver, between the flange 21 and the rear surface 12' of wall 12. The snap-fit engagement is provided by retention means 23 in the opposed parallel side walls 20' of the rear wall member. The retention means are herein constituted by retention tabs which are stamped out of the side walls 20'. These tabs are located adjacent a free end edge of the side walls 20' whereby to engage behind the inwardly extending flange portions 16, as shown in FIGS. 2 and 3. The abutment flange 21 also rests against a rear face 12' of the frontal wall portion 12 when the cup-shaped member is in engagement with the flange means 15. Also, as shown in the drawings the side wall portions 20' are shown extending parallel to one another and are spaced apart a distance equal to the distance between the free ends of the inwardly extending flange portions 16.

Since rear wall member 18, side walls 20 and the inwardly extending flange portions 16 are formed of sheet metal, these will flex whereby they may be engaged and disengaged with each other. By applying a force in the direction of arrow 24 the inwardly extending flange portions 16 will flex inwardly towards one another. Also, the opposed horizontal side walls 20' will flex outwardly. The shape of the flange means is shown by the phantom lines 25 in FIG. 1. As herein shown, the flanges along the horizontal side walls 20' are longer than those along the end edges 14 of the slot opening 13. Thus, these will be more flexible in the area where they are in snap-fit engagement with the rear wall member 18.

Referring now to FIGS. 1 and 3 there is shown the provision of an information carrying member 26 which may be provided in snap-fit engagement between the parallel horizontal edges of the slot and the rear wall portion 19 of the rear wall member 18. The information carrying member is formed of plastics material having a transparent front wall 27. Opposed slots 28 are provided in top and bottom walls 29 and 30 respectively, for receiving an information strip 31 in sliding fit therebetween over a rear face of the front wall 27. Opposed retention flanges 32 extend rearwardly of the top and bottom walls 29 and 30 respectively, for bridging engagement between the inwardly extending flange portions 16 and the rear wall 19 of the rear wall member whereby the information carrying member is retained in the slot opening and is slidably displaced thereacross. In order to remove the information carrying member it is only necessary to grasp it from its opposed ends 33 and pull it outwardly of the slot opening 13 causing the member to flex and dislodge itself from within the slot opening.

It is within the ambit of the present invention to cover any obvious modifications of the example of the preferred embodiment described herein, provided such modifications fall within the scope of the appended claims.

We claim:

1. A flush drawer handle for a drawer having at least a flat rigid frontal wall portion about said handle, said handle comprising a handle slot having opposed horizontal edges and end edges, flange means at least in opposed ones of said horizontal edges and formed integral with said frontal wall portion and extending inwardly of said frontal wall portion, a rear wall member having a rear wall portion and side wall portions extending transverse to a common side of said rear wall portion, said side wall portions having retention means for releasable securement with said flange means rearwardly of said frontal wall portion and further having an integrally formed abutment flange at a free end edge thereof extending parallel to said rear wall portion thereof, said rear wall member surrounding the entire handle slot with said rear wall portion disposed parallel to said slot and recessed therefrom whereby to receive an information carrying member in snap-fit engagement between said parallel horizontal edges and said rear wall portion of said rear wall member.

2. A flush drawer handle as claimed in claim 1 wherein said frontal wall is constructed of sheet metal, said side wall portions having retention means are spaced apart a distance equal to the distance between free ends of said flange means in at least opposed ones of said edges.

3. A flush drawer handle as claimed in claim 2 wherein said retention means are small retention tabs extending inwardly in each said side wall portions adjacent a free end edge thereof.

4. A flush drawer handle as claimed in claim 3 wherein said flange means are inwardly bent edge portions of said frontal wall portion about at least said opposed horizontal edges of said slot opening and further defining smooth rounded horizontal slot edges.

5. A flush drawer handle as claimed in claim 4 wherein said rear wall member is a cup-shaped member, said side wall portions extending entirely about and transversely to said rear wall portion.

6. A flush drawer handle as claimed in claim 5 wherein said handle slot opening is a horizontal slot defined by opposed parallel horizontal edges and end edges, said cup-shaped member being an elongated member having elongated parallel side wall portions provided with said retention tabs for frictional engagement behind a respective one of said bent edge portions of said parallel horizontal edges, said elongated parallel side wall portions having integrally formed abutment flanges in their free end edge extending parallel to said rear wall portion, said abutment flange resting against a rear face of said flat metal frontal wall portion when said cup-shaped member is engaged with said bent edge portions of said parallel horizontal edges.

7. A flush drawer handle as claimed in claim 6 wherein said elongated parallel side wall portions are substantially flexible to permit flexion thereof sufficiently to cause disengagement thereof with said bent edge portions by the application of pressure from inwardly of said cup.

8. A flush drawer handle as claimed in claim 2 wherein said handle slot opening is an elongated horizontal slot defined by opposed parallel horizontal edges and end edges.

9. A flush drawer handle as claimed in claim 1 wherein said information carrying member is formed of plastics material having a transparent front wall, opposed slots in a top and bottom rear wall for receiving an information strip in sliding fit therebetween over a rear face of said front wall, and opposed retention flanges extending rearwardly of said top and bottom rear wall for bridging engagement between said inwardly bent edge portions of said parallel horizontal edges and said rear wall member to retain said information carrying member in said slot opening in sliding displacement therein.

10. A flush drawer handle as claimed in claim 1 wherein said abutment flange is provided with tool engagement means for removal of said rear wall member from its frictional engagement with said flange means.

* * * * *